US005237745A

United States Patent [19]

Yamanaka

[11] Patent Number: 5,237,745

[45] Date of Patent: Aug. 24, 1993

[54] METHOD OF AND APPARATUS FOR MANUFACTURING DRIVE PLATE

[75] Inventor: Shigeaki Yamanaka, Hiroshima, Japan

[73] Assignee: Kubota Iron Works Co., Ltd., Hiroshima, Japan

[21] Appl. No.: 812,990

[22] Filed: Dec. 24, 1991

[30] Foreign Application Priority Data

Dec. 28, 1990 [JP] Japan ..... 2-415666
Jun. 14, 1991 [JP] Japan ..... 3-169009

[51] Int. Cl.[5] ..... B21K 1/42

[52] U.S. Cl. ..... 29/893.34; 29/893.3; 72/68

[58] Field of Search ..... 29/893.34, 893.35, 893.36, 29/893, 893.3; 72/68

[56] References Cited

U.S. PATENT DOCUMENTS 659,723 10/1900 Williams ..... 72/102
2,654,944 10/1953 Wilson .
5,068,964 12/1991 Yabuno et al. ..... 29/892.3

FOREIGN PATENT DOCUMENTS 3715392 3/1988 Fed. Rep. of Germany .
3819957 3/1989 Fed. Rep. of Germany .
2282303 3/1976 France .
2524354 10/1983 France .
54-20190 7/1979 Japan .
54-44259 12/1979 Japan .
342 1/1983 Japan ..... 72/110
129241 6/1986 Japan ..... 29/892.2
2045665 11/1980 United Kingdom .

*Primary Examiner*—P. W. Echols
*Attorney, Agent, or Firm*—Armstrong, Westerman, Hattori, McLeland & Naughton

[57] ABSTRACT

A method of manufacturing a driver plate comprises the steps of swaging the outer peripheral portion of a disk-shaped raw material in the radial direction thereof using a swaging die so as to form the outer peripheral portion in a thick wall portion, holding the swaged material between an upper and a lower die and pressing the material through the upper and lower dies so as to form it into a dish-shaped blank, and pressing radially the thick-walled outer peripheral portion of the dish-shaped blank held between a support die disposed either on the outside or on the inside thereof and a gear tooth profile forming die so as to form gear teeth either on the radially outside or on the radially inside of the outer peripheral portion. As an alternative, gear teeth may be formed by cold rolling work or gear teeth cutting work using a gear hobbing machine or one of other gear teeth cutting machines.

11 Claims, 3 Drawing Sheets

METHOD OF AND APPARATUS FOR MANUFACTURING DRIVE PLATE

BACKGROUND OF THE INVENTION

1. Field of the Invention

This invention relates to a method of manufacturing drive plates for use in drive gears of clutches for motor vehicles.

2. Description of the Prior Art

Large sized drive plates each of which diameter is 200 mm or more have been manufactured by the steps of press-fitting a dish-shaped member formed by pressing a disc-shaped thin plate material into an annular gear member having gear teeth formed along the outer periphery of an annular raw material, and fixedly securing both the component parts by welding.

Further, besides the above-mentioned method of manufacturing a drive plate, there are methods of manufacturing a drive plate comprising the steps of forming an outer peripheral portion of a disk-shaped thin plate material in a thick peripheral wall by folding as disclosed in Japanese Patent Publications Nos. SHO 54-44259 and SHO 54-20190 or spinning that portion as disclosed in West German Patent No. 38 19 957, and then forming gear teeth at the thick-walled peripheral portion.

Out of the above-mentioned prior art methods, in the former method of manufacturing a drive plate from the two component parts, since the gear teeth of a gear member are formed by machining using a gear hobbing machine, the cost of the products will increase, and also since the two component parts are fixedly secured by welding, causing deformation of the products due to welding strain, it has been necessary to remove the welding strain throughout the whole welded joints.

While in the latter method of manufacturing a drive plate by forming a thin plate into a dish-shaped portion and a gear portion integrally, it is difficult to form gear teeth, and also it is difficult to form the thick-walled peripheral portion having a uniform thickness. Particularly, in the method of forming the thick-walled peripheral portion by spinning, it is difficult to obtain a wall thickness enough to form gear teeth.

SUMMARY OF THE INVENTION

The present invention has for its object to provide a method of manufacturing a drive plate, which is an improvement of the latter method in the above-mentioned prior art manufacturing methods of a drive plate comprising the steps of forming a dish-shaped portion on the side of a boss thereof and a gear portion on the side of an outer peripheral portion thereof integrally, wherein in the step of forming a disc-shaped thin plate material, a thick wall portion having a sufficient thickness can be formed at the outer peripheral portion thereof, and also gear teeth can be formed at the thick wall portion without having to carry out any after-machining.

To achieve the above-mentioned object, according to a first aspect of the present invention, there is provided a method of manufacturing a drive plate comprising the steps of swaging an outer peripheral portion of a disc-shaped raw material in the radial direction thereof through a swaging die so as to form the outer peripheral portion in a thicker wall portion as compared with the remainder thereof, holding said swaged material between an upper die and a lower die and pressing the material through the upper and lower dies so as to form it into a dish-shaped blank, and pressing radially the thick-walled outer peripheral portion of said dish-shaped blank held between a support die disposed either on the outside or on the inside thereof and a gear tooth profile forming die so as to form gear teeth either on the radially outside or on the radially inside of the outer peripheral portion.

Further, to achieve the above-mentioned object, according to a second aspect of the present invention, there is provided a method of manufacturing a drive plate comprising the steps of swaging an outer peripheral portion of a disc-shaped blank in the radial direction thereof through a swaging die so as to form the outer peripheral portion in a thicker wall portion as compared with the remainder thereof, holding the swaged material between an upper die and a lower die and pressing the material through the upper and lower dies so as to form it into a dish-shaped blank, and allowing either the radially outer peripheral end or the radially inner peripheral end of the thick-walled outer peripheral portion to be subjected to cold rolling work or gear teeth cutting work using a hobbing machine or one of other gear teeth cutting machines of the same kind.

According to the present invention, in case of forming a disc-shaped thin plate material into a drive plate as an integral unit, a blank having a thick-walled portion of a sufficient thickness can be formed in the outer peripheral portion thereof by swaging the plate material, and also gear teeth can be formed on the outer peripheral portion of the swaged blank without having to carry out any after-machining.

The above-mentioned and other objects, aspects and advantages of the present invention will become apparent to those skilled in the art by making reference to the following description and the accompanying drawings in which preferred embodiments incorporating the principles of the present invention are shown by way of example only.

DETAILED DESCRIPTION OF PREFERRED EMBODIMENTS

The present invention will now be described in detail below by way of several embodiments thereof with reference to the accompanying drawings.

Figure 1:
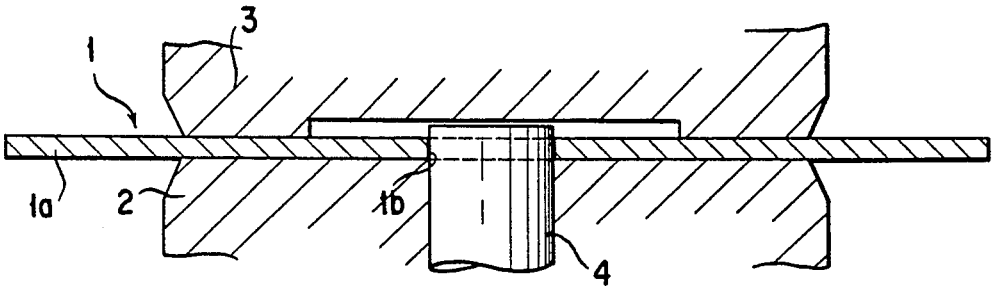
FIG. 1 is a sectional view showing a condition of a disc-shaped thin plate material fixedly secured to a positioning pin so as to be subjected to swaging.

As shown in FIG. 1, a disc-shaped thin plate material 1, which is obtained by punching a thin plate material of 2 to 3 mm thick in a disc-like shape, is fixedly secured with the radially inward area of the material, which is not subjected to the swaging process, held between fixing bed 2 and pushing plate 3. Positioning of the disc-shaped material 1 is made by fitting a positioning pin 4 mounted coaxially on the fixing bed 2 into a circular hollow portion 1*b* formed by punching around the axis of the material 1.

Figure 2:
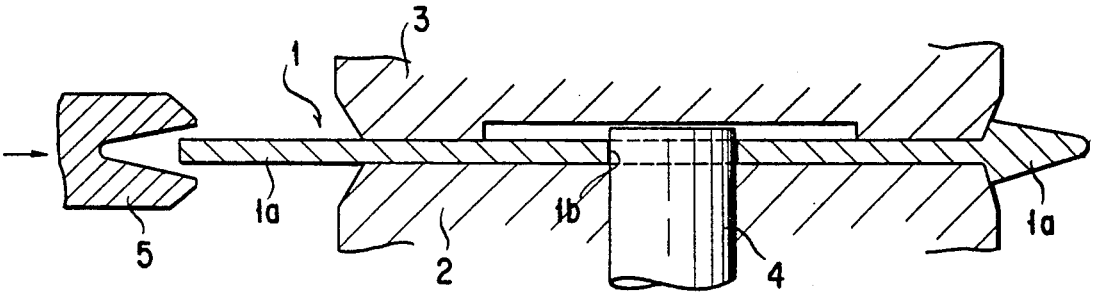
FIG. 2 is a sectional view showing a first swaging process.

Subsequently, as shown in FIG. 2, a radially outer peripheral portion 1*a* of the disc-shaped material 1 is subjected to a first swaging process by a first swaging die 5 which acts towards the axis of the material 1 in the radial direction. By this first swaging, the radially outermost end of the peripheral portion of the material 1 is formed thinner than, a radially inner part of the peripheral portion.

Figure 3:
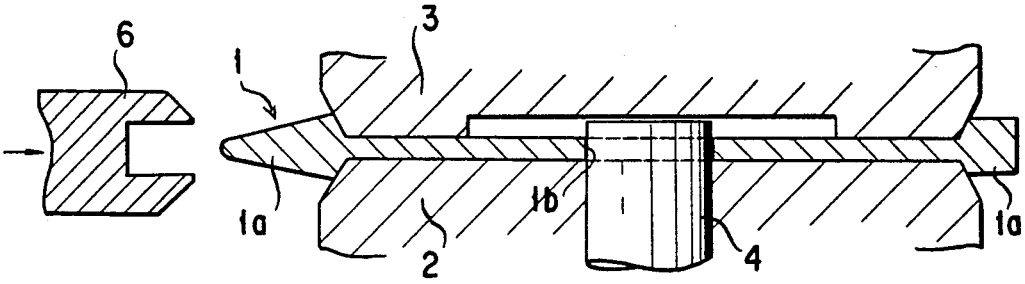
FIG. 3 is a sectional view showing a second swaging process.

After that, as shown in FIG. 3, the swaged outer peripheral portion la is subjected to second swaging by a second swaging die 6 so that it is formed into a rectangular shape in section.

Figure 4:
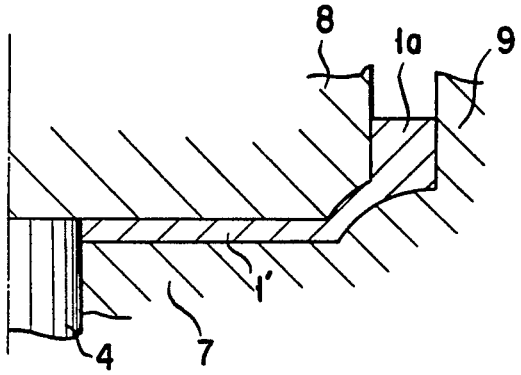
FIG. 4 is a sectional view showing a blank forming process.

Subsequently, as shown in FIG. 4, the thin plate-shaped portion of the swaged material 1' which has been subjected to the first and second swaging is formed into a dish-shaped member by a lower die 7 and an upper die 8. At that time, the outer peripheral portion of the swaged material 1' is regulated by an inner peripheral side wall 9 of the lower die 7. This forming results in a dish-shaped blank 10. Further, as the inner peripheral side wall 9, an outer die which is separate from the lower die 7 may be used.

Next, for example, the swaged outer peripheral portion of the blank 10 is subjected to a cold die forging so that it is formed into an external gear.

Figure 5:
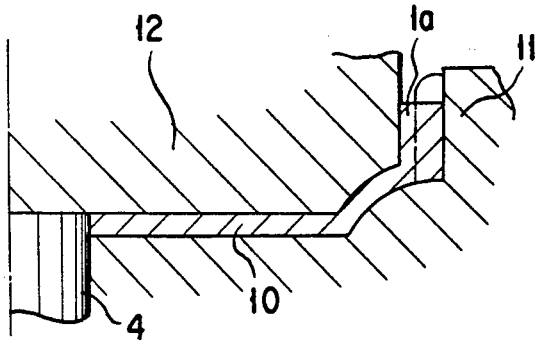
FIG. 5 is a sectional view showing gear teeth profile forming process.

One example of this external gear forming process is shown in FIG. 5. The above-mentioned blank 10 is located coaxially inside of an external gear tooth profile forming die 11 having a gear tooth profile in the inner periphery thereof, and then a support die 12 is axially pressed into the radial inside of the blank 10 so that the outer peripheral portion la thereof which has been swaged is formed with external gear teeth.

At that time, the outside diameter of the support die 12 is larger than the inside diameter of the dish-shaped blank 10, and when the support die 12 is pressed into the blank 10, the swaged outer peripheral portion 1*a* of the blank 10 is pressed out, thereby forming external gear teeth each corresponding to the gear tooth shape of the external gear tooth profile forming die 11 on the radial outside portion.

Figure 6:
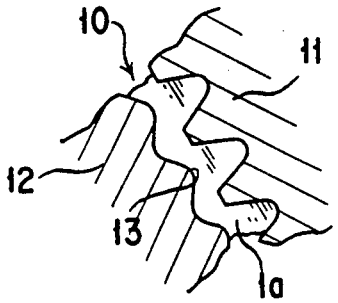
FIG. 6 is a plan view showing principal parts of an outer tooth profile forming die and an inner support die for use in the gear teeth forming process.

Further, at that time, by forming the outer peripheral portion of the support die 12 in a wave shape 13 having the same pitch as that of the gear tooth profile of the external gear tooth profile forming die 11, as shown in FIG. 6, it has become possible to form the above-mentioned external gear teeth readily, and mass-produce large drive plates each having a diameter of 200 mm or over, mass-production of which has been heretofore difficult.

While in the above-mentioned embodiment there is shown a method of forming external gear teeth in the swaged outer peripheral portion 1*a* of the blank 10, by locating an internal gear profile forming die on the radial inside of the swaged outer peripheral portion 1*a* of the blank 10, and pressing the swaged outer peripheral portion 1*a* radially inwards by a support die, which is located on the radial outside thereof, in the process shown in FIGS. 5 and 6, internal gear teeth can be formed along the radial inside of the swaged outer peripheral portion 1*a* of the blank 10.

Figure 7:
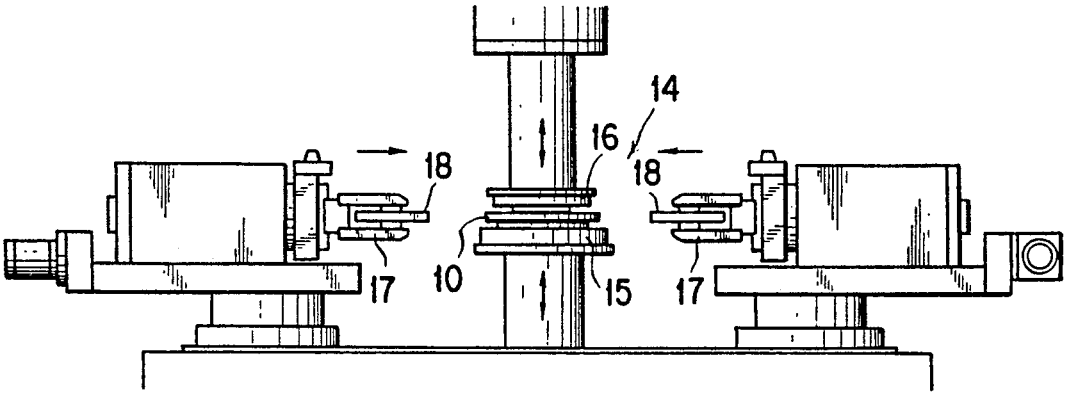
FIG. 7 is a front elevational view showing one example of the gear tooth cold-rolling machine.

Further, while in each of the above-mentioned embodiments there is shown one example of the method of die forging gear teeth by means of the gear tooth profile forming die and the support die, the gear teeth may be formed along the swaged outer peripheral portion of the blank 10 using a gear tooth cold rolling machine 14 as shown in FIG. 7. This gear teeth cold rolling machine 14 is of a conventional type, and is arranged such that the blank 10 is held between a vertically movable table 15 and a pushing plate 16 which are located at the center of the apparatus, and cold rolling dies 18, 18 supported by supporting beds 17, 17 are thrust against the outer peripheral end face of the blank 10 so as to form rolled gear teeth.

Yet further, the blank 10 which has been subjected to the process shown in FIG. 4 may be formed with internal gear teeth or external gear teeth by machining using a gear hobbing machine or the like. Further, the forming of the gear teeth may be made by a cold rolling process using fixed machine tools.

It is to be understood that the foregoing description is merely illustrative of preferred embodiments of the present invention, and that the scope of the invention is not to be limited thereto, but is to be determined by the scope of the appended claims.

What is claimed is:

1. A method of manufacturing a drive plate comprising the steps of:

providing a disc-shaped plate material of original thickness;

swaging an outer peripheral portion of the disc-shaped plate material in the radial direction thereof through a swaging die for thickening the outer peripheral portion so as to provide a second thickness at said peripheral portion thicker than said original thickness;

holding said material swaged in the swaging step, between an upper die and a lower die and pressing the material through the upper and lower dies so as to form a dish-shaped blank, and pressing radially the thick-walled outer peripheral portion of said dish-shaped blank held between a support die disposed on either the outside or the inside thereof and a gear tooth profile forming die so as to form gear teeth either on the radial outside or on the radial inside of the outer peripheral portion.

2. A method of manufacturing a drive plate as claimed in claim 1, wherein said gear teeth forming step is conducted by the support die disposed on the inside of said blank and the gear tooth profile forming die disposed on the outside of said blank, and when the thick-walled outer peripheral portion of said blank is pressed through the support die from the radial inside thereof towards the radial outside thereof the radially outer peripheral end face of said thick-walled outer peripheral portion is formed with gear teeth.

3. A method of manufacturing a drive plate as claimed in claim 1, wherein said gear teeth forming step is conducted by the support die disposed on the outside of said blank and the gear tooth profile forming die disposed on the inside of said blank, and when the thick-walled peripheral portion of said blank is pressed through the support die from the radial outside thereof towards the radial inside thereof the radially inner peripheral end face of said thick-walled outer peripheral portion is formed with gear teeth.

4. A method of manufacturing a drive plate as claimed in claim 1, wherein the peripheral end portion of the support die which is used in said gear teeth forming step is formed in a wave shape having the same pitch as that of the gear teeth formed in said gear tooth profile forming die.

5. A method of manufacturing a drive plate according to claim 1, wherein in the swaging step, the outer peripheral portion of the disc-shaped plate material is first swaged so as to provide the radially outermost portion of the thickened peripheral portion with a lesser thickness than more radially inner portions of the thickened peripheral portion, and subsequently the thickened outer peripheral portion of varying thickness is further swaged to provide a thickened outer peripheral portion of substantially the same thickness throughout.

6. A method of manufacturing a drive plate according to claim 5, wherein in the swaging step, the outer peripheral portion when swaged to have an increased but variable thickness has a cross-section thereof substantially cone-shaped, and wherein when the outer peripheral portion is further swaged to provide a thickened outer peripheral portion of substantially constant thickness, the cross section thereof is substantially rectangular.

7. A method of manufacturing a drive plate comprising the steps of:

providing a disc-shaped plate material of original thickness;

swaging an outer peripheral portion of the disc-shaped plate material in the radial direction thereof through a swaging die for thickening the outer peripheral portion so as to provide a second thickness at said peripheral portion thicker than said original thickness;

holding said material swaged in the swaging step between an upper die and a lower die and pressing the material through the upper and lower dies so as to form a dish-shaped blank, and subjecting either the radial outside or the radial inside of the thick-walled outer peripheral portion of the blank to cold rolling work or gear teeth cutting work using a gear hobbing machine or a gear teeth cutting machine.

8. A method of manufacturing a drive plate according to claim 7, wherein in the swaging step, the outer peripheral portion of the disc-shaped plate material is first swaged so as to provide the radially outermost portion of the thickened peripheral portion with a lesser thickness than more radially inner portions of the thickened peripheral portion, and subsequently the thickened outer peripheral portion of varying thickness is further swaged to provide a thickened outer peripheral portion of substantially the same thickness throughout.

9. A method of manufacturing a drive plate according to claim 7, wherein in the swaging step, the outer peripheral portion when swaged to have an increased but variable thickness has a cross-section thereof substantially cone-shaped, and wherein when the outer peripheral portion is further swaged to provide a thickened outer peripheral portion of substantially constant thickness, the cross section thereof is substantially rectangular.

10. A method of manufacturing a drive plate comprising the steps of:

providing an essentially disc-shaped plate material having an axis and circumference and a substantially uniform thickness in overall area thereof;

swaging the outer circumference of said disc-shaped plate material to form a swaged disc having a thickened peripheral portion;

pressing said swaged disc to bend said peripheral portion to form a rim portion extending in a substantially axial direction; and processing said rim portion for forming gear teeth on one of a radially inner periphery and a radially outer periphery of said rim portion with a first die mating with said one of radially inner and outer peripheries and having a gear teeth profile conforming with the gear teeth to be formed on one of said radially inner and outer peripheries and a second die mating with the other of said radially inner and outer peripheries and having a waved profile with a waving pitch substantially corresponding to the pitch of said gear profile of said first die.

11. A system of manufacturing a drive plate from an essentially disc-shaped plate material having an axis and circumference and a substantially uniform thickness in overall area thereof, comprising:

swaging means for swaging the outer circumference of said disc-shaped plate material to form a swaged disc having a thickened peripheral portion;

first pressing means for pressing said swaged disc for bending said peripheral portion for forming a rim portion extending in a substantially axial direction; and second pressing means for processing said rim portion for forming gear teeth on one of a radially inner periphery and a radially outer periphery of said rim portion, said second pressing means including;

a first die mating with said one of radially inner and outer peripheries and having a gear teeth profile conforming with the gear teeth to be formed on one of said radially inner and outer peripheries; and a second die mating with the outer of said radially inner and outer peripheries and having a waved profile with a waving pitch substantially corresponding to the pitch of said gear profile of said first die.

* * * * *